United States Patent [19]

Bexley et al.

[11] 4,377,430

[45] Mar. 22, 1983

[54] PROCESS OF MAKING BOOK COVERS

[76] Inventors: Robert G. Bexley, 46 Southwind Cir., St. Augustine; Barry South Thomson, 26 Sandpiper Dr. South, St. Augustine Beach, both of Fla. 32084

[21] Appl. No.: 251,393

[22] Filed: Apr. 6, 1981

[51] Int. Cl.[3] ..... F27B 21/00

[52] U.S. Cl. ..... 156/184; 156/191; 156/268; 156/270; 412/4; 281/19 R; 281/20; 281/29

[58] Field of Search ..... 156/211, 226, 227, 257, 156/268, 270, 477 B, 184, 191; 11/2; 281/19 R, 20, 29; 83/861, 875, 880

[56] References Cited

U.S. PATENT DOCUMENTS

| | | | |
|---|---|---|---|
| 3,454,694 | 7/1969 | Delaire et al. | 11/2 |
| 4,111,460 | 9/1978 | Roberts | 281/29 |
| 4,179,325 | 12/1979 | Stoats et al. | 11/2 |
| 4,209,187 | 6/1980 | Forrest | 281/19 R |

FOREIGN PATENT DOCUMENTS

| | | | |
|---|---|---|---|
| 1303214 | 1/1973 | United Kingdom | 281/29 |

*Primary Examiner*—Caleb Weston

*Attorney, Agent, or Firm*—William M. Hobby III

[57] ABSTRACT

A book cover making process feeds transparent polymer sheet material from a roll of material across a plurality of roller cutting blades for making cuts a portion of the way through the material. The polymer sheet material being fed is coated with adhesive in two space coats on either side of the cut lines on the opposite side of the sheet from the cut lines. The coated adhesive is covered with backing material and the polymer sheet material is then cut into predetermined sizes to form book covers. The coating and backing may be done in one operation and rewound onto a roll and fed from the rewound roll for cutting to size and then have a plurality of lines cut into the individual polymer sheets.

4 Claims, 3 Drawing Figures

PROCESS OF MAKING BOOK COVERS

BACKGROUND OF THE INVENTION

The present invention relates to book covers, and especially to transparent polymer book covers adapted to be rapidly attached to paperback or soft cover books to protect the books from damage.

A wide variety of book covers have been provided in the past for the protection of books or for the conversion of paperback or soft cover books to hardback books. An inexpensive transparent cover is especially desirable for institutions such as libraries, in which paperback books receive more intensive use by a large number of parties than the books are made to withstand, which results in the covers coming loose from the books, otherwise becoming damaged.

A typical prior art patent showing a self binder for books, pamphlets, and the like, may be seen in U.S. Pat. No. 3,904,227, which provides self binding cover sheet material which is scored in a geometric pattern to allow the sheet material to fit a variety of sizes of books. Unlike this patent, the present invention does not score the material, but actually cuts it in a uniform pattern rather than a geometric pattern to provide a book cover which can be rapidly attached to those books expecting heavy use. Other book covers can be seen in U.S. Pat. No. 3,241,863 and in U.S. Pat. No. 3,891,240. A book binding process can be seen in U.S. Pat. No. 4,019,758, and a protective case for books shown in the Feather U.S. Pat. No. 3,159,327. A process for converting paperback books to a hardback book is seen in the Hertzberg U.S. Pat. No. 3,161,423, while an imitated normal hardback book cover is provided in U.S. Pat. No. 3,231,296. In U.S. Pat. No. 3,964,770, a case for books provides a pressure sensitive resilient spine pad; and in U.S. Pat. No. 3,957,287, a book cover is formed from a synthetic resin. U.S. Pat. No. 3,749,423 has pressure sensitive end sheets for uncased books and a method and apparatus for casing books; while U.S. Pat. No. 4,209,187 has a book cover for paperback volumes with folded-in, longitudinal flaps at opposed edges thereof and may be provided with optional reinforcing boards. In U.S. Pat. No. 4,072,326, a wrap around cover for books provides for wrapping around the spine of a book of the type bound together by a pair of plastic binding strips and studs holding the sheets together. In U.S. Pat. No. 3,822,244, an adhesive binding cover is provided; while U.S. Pat. No. 3,314,089 is for a machine for producing imitated normal hardback covers and a method therefore; while U.S. Pat. No. 3,133,750 has a book cover using a covered adhesive for the spine of the book. U.S. Pat. No. 3,297,341 is a book protector.

The present invention provides a method of making transparent book covers ready to attach to a paperback or other book in which a plurality of cuts are made to provide for variable thicknesses of books, which books are made in a highly automated process.

SUMMARY OF THE INVENTION

A process is provided for making a book cover which has the steps of feeding a polymer sheet from a roll of polymer sheet material and cutting a plurality of lines a portion of the way through the polymer sheet being fed from the roll of polymer material. The polymer material is coated with an adhesive on one side thereof as it is being fed from the roll in two spaced coats and backing material is applied over the adhesive from a pair of rolled sheet backing material. The polymer sheet material is then cut to size and discharged to form a book cover. The step of cutting a plurality of lines a portion of the way through a polymer sheet includes cutting a line from five to seven mils into an approximately fifteen mil sheet of polymer, so that a stiffer polymer material can be used than is commonly used for book covers of this type. The second embodiment feeds a polymer sheet with two layers of adhesive with a backing material and then rewinds the polymer in reverse onto a second roll. The rewound roll is then fed to a cutter where it is cut, and the cut portions are positioned and fed into a plurality of roller cutters to cut the plurality of lines a portion of the way through the polymer sheet material.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
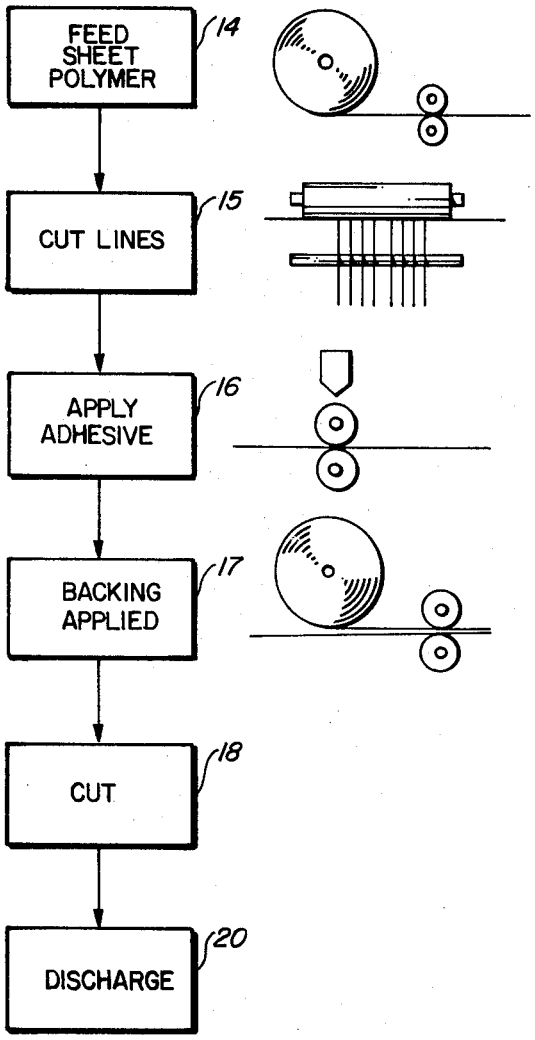
FIG. 1 is a flow diagram of a process in accordance with the present invention.
Figure 2:
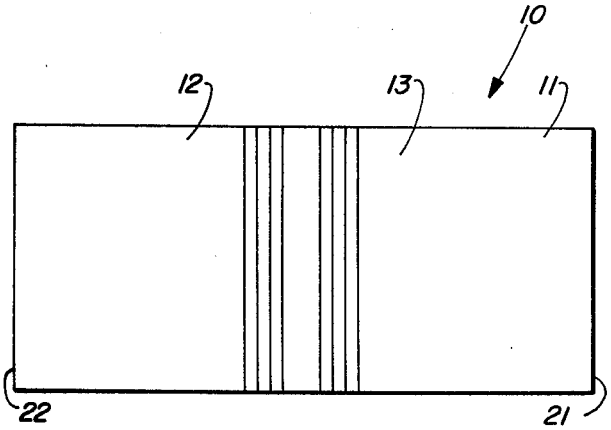
FIG. 2 is an elevational view of a book cover made in accordance with the process of FIG. 1.

Referring to FIGS. 1 and 2 of the drawings, a process for making a book cover 10 from a transparent polymer such as fifteen mil polyethylene terephytholate, as shown in FIG. 2, has an adhesive applied to sides 11 and 12 which has been covered with a covering material. The cuts and adhesives are on opposite sides of said cover. The cut lines 13 are cut from five to seven mils into a fifteen mil sheet of polymer sheet. The cutting of lines into a polymer sheet differs from the normal book cover, which uses scoring done by a dull impression from a blade rather than a sharp cut into the material. The scored line is satisfactory for many materials, but is not useful in more rigid materials such as some polymers. An accurately cut line of predetermined depth in certain polymers will allow the polymer to be folded on the line and yet maintain its integrity over a large number of folds and heavy use. The process of making the book cover of FIG. 2 feeds the fifteen mil polymer material from a roll in Step 14 to a plurality of roller blades mounted on one side away from a platen roller to cut lines 13 into the material a predetermined distance, such as five to seven mils on a fifteen mil sheet. An adhesive is applied at sixteen to the other side of the polymer sheet, with rollers being fed from glue pots in a conventional manner. The adhesive coating then has wax paper or other backing material applied thereover from two rolls as the adhesive coating is applied in two lines to both sides of the book cover material. The backing is applied at 17 and thereafter the sheet material is cut with a guillotine type cutter at 18 and discharged from the process 20. The resulting book cover is shown in FIG. 2 and allows the user to cut off each edge 21 and 22 to the size of the book being used and folded on a particular cut line 13 to match the thickness of the book over the spine of book. The adhesive cover is peeled off the covering of the adhesive on the sides 11 and 12 and the transparent sides 11 and 12 are attached to the existing cover of the book. The transparent nature of the cover allows the original cover to be viewed directly through the transparent added cover. The plurality of lines 13 allow different thicknesses of books to be covered with the same cover, but also allows a better opening and closing of the cover by the plurality of cuts.

Figure 3:
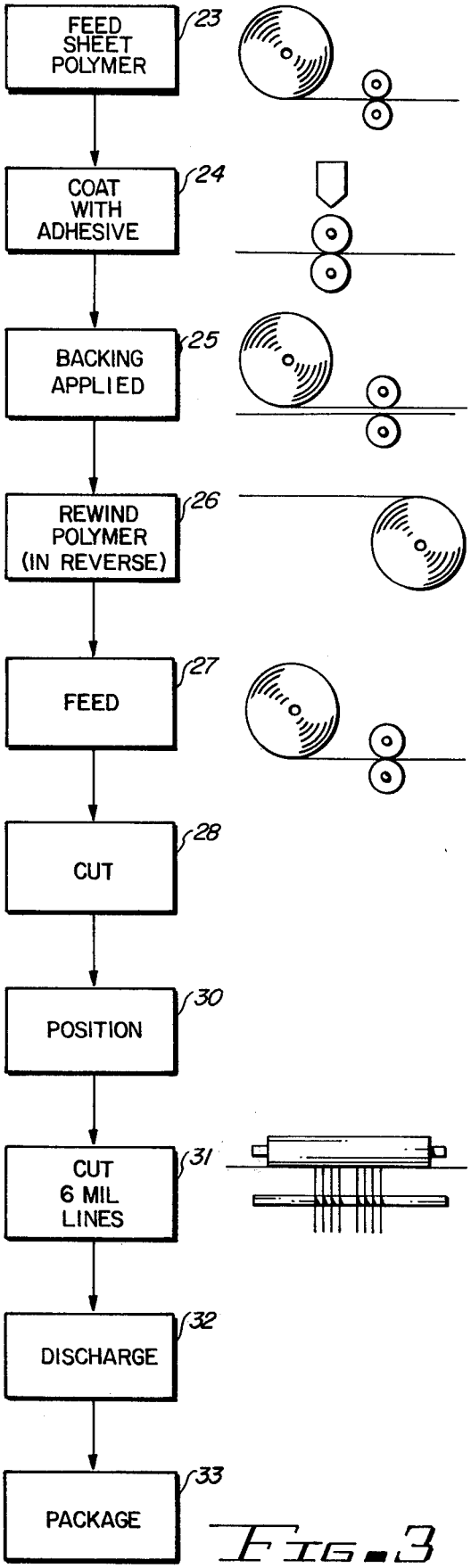
FIG. 3 is a flow diagram of a second embodiment of a process of making a book cover in accordance with FIG. 2.

A second process is shown in FIG. 3, in which a sheet polymer is fed at 23 to a coating step when adhesive coating 24 is applied in two layers to either side of the polymer sheet. A pair of adhesive covering sheets are applied at 25 to cover the polymers but to leave the middle section of the plastic sheet uncovered. The polymer sheet having the adhesive coating and backing thereon is rewound 26 onto a roll in reverse and is later fed from the rewound roll 27, where it is cut with a guillotine cutter at 28 and stacked in stacks. The cut material looks similar to that shown in FIG. 2, except that it does not have the cut lines 13. The cut portions are positioned 30 and fed in rapid order through a plurality of tandemly mounted roller cutters 31, which cuts a plurality of lines, such as six mil deep, into the transparent cover. The covers which now are completed as in FIG. 2, are discharged at 32 and packaged in Step 33.

The present process allows an improved book cover to be made out of stiffer, long lasting materials which were not previously suitable for use as book covers in a high production process. The present invention, however, is not to be considered as limited to the particular steps shown, which are to be considered to be illustrative rather than restrictive.

I claim:

1. A process of making a backing cover including the steps of:

feeding polymer sheet material from a roll of polymer sheet material;

coating adhesive onto one side of polymer sheet being fed from a roll of polymer material into spaced coats;

applying sheet backing material to each of said adhesive coats from a pair of rolled sheet backing material;

rewinding said polymer material having said covered adhesive thereon backwards onto a roll;

feeding said rewound polymer material from said roll;

cutting and discharging sheets from said polymer sheet and covered adhesive thereon; and cutting a plurality of lines a portion of the way through polymer sheet, including cutting lines from five to seven mils into said polymer sheet material.

2. A process in accordance with claim 1, in which the step of feeding polymer sheet material from a roll includes feeding a transparent polymer sheet from a roll of transparent polymer sheet material.

3. A process in accordance with claim 2, in which the step of cutting a plurality of lines a portion of the way through said polymer sheet includes cutting eight lines a portion of the way through said polymer sheet material.

4. A process in accordance with claim 3, in which the cutting of a plurality of lines a portion of the way through said polymer sheets includes feeding each sheet through a plurality of roller cutting dyes, said sheet having a thickness of approximately fifteen mils.

* * * * *